United States Patent [19]

Latimer et al.

[11] 4,406,737

[45] * Sep. 27, 1983

[54] CREPING PAPER USING CATIONIC WATER SOLUBLE ADDITION POLYMER

[75] Inventors: Joseph J. Latimer, Perkiomenville; Travis E. Stevens, Ambler, both of Pa.

[73] Assignee: Rohm and Haas Company, Philadelphia, Pa.

[ * ] Notice: The portion of the term of this patent subsequent to Dec. 29, 1998 has been disclaimed.

[21] Appl. No.: 301,345

[22] Filed: Sep. 11, 1981

Related U.S. Application Data

[63] Continuation of Ser. No. 684,427, May 7, 1976, Pat. No. 4,308,092, which is a continuation-in-part of Ser. No. 640,664, Dec. 15, 1975, abandoned.

[51] Int. Cl.[3] ..... D21H 5/24

[52] U.S. Cl. ..... 162/111; 162/112; 162/168.2; 162/168.3; 162/168.4; 162/168.5

[58] Field of Search ..... 162/111, 112, 164.3, 162/164.6, 168.1, 168.2, 168.6

[56] References Cited

U.S. PATENT DOCUMENTS

| | | | |
|---|---|---|---|
| 2,964,445 | 12/1960 | Daniel | 162/168 N |
| 3,301,746 | 1/1967 | Sanford et al. | 162/113 |
| 3,507,847 | 4/1970 | Williams et al. | 162/168 N |
| 3,640,841 | 2/1972 | Winslow et al. | 162/112 |
| 3,678,098 | 7/1972 | Lewis et al. | 162/168 N |
| 3,694,393 | 9/1972 | Lewis et al. | 162/168 N |
| 3,702,799 | 11/1972 | Lewis et al. | 162/168 N |
| 3,842,054 | 10/1974 | Keim | 162/168 N |

FOREIGN PATENT DOCUMENTS 979579 12/1975 Canada .

*Primary Examiner*—Peter Chin

*Attorney, Agent, or Firm*—Harold L. Greenwald; Michael B. Fein

[57] ABSTRACT

A procedure is disclosed for creping paper without conferring wet strength or sizing thereto.

20 Claims, 1 Drawing Figure

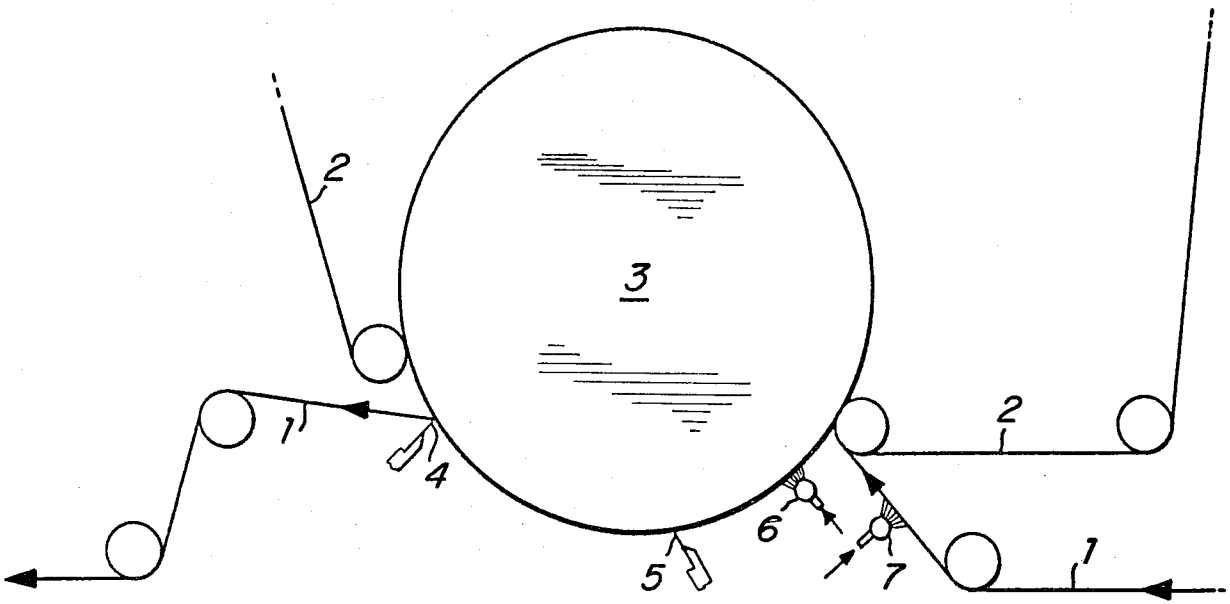
1
2
7
6
5
3
4
2
1

CREPING PAPER USING CATIONIC WATER SOLUBLE ADDITION POLYMER

This is a continuation of application Ser. No. 684,427, filed May 7, 1976, now U.S. Pat. No. 4,308,092, which is a continuation-in-part of Ser. No. 640,664, filed Dec. 15, 1975, now abandoned.

This invention relates to a procedure for creping paper such as toilet tissue, facial tissue, and paper towelling which can be repulped or disintegrated in water, so that the materials may be readily flushed in toilets, and to paper prepared by this procedure.

The invention is in a method of creping paper comprising the steps of incorporating in paper pulp or a web of paper from 0.05% to 7%, preferably 0.05% to 1%, more preferably 0.05% to 0.5% by weight based on bone dry fibers (essentially 0% free moisture), of a cationic water soluble addition polymer in aqueous solution. The polymer contains amine groups, and optionally quaternary ammonium groups, the relative ratios of these groups to any other mer units in the polymer being such that a salt of the amine groups of the polymer, with an organic or inorganic acid, is soluble in water. The paper pulp is formed into a web by well known procedures. The web is applied to a hot drying surface such as a Yankee dryer, and is doctored from the surface at a point at which said web contains a moisture content of between about 2% and 50%, preferably between about 4% and 30%, whereby creping of the paper is achieved. The molecular weight of the soluble polymer on a viscosity average basis, ranges from 25,000 to 1,000,000, the preferred range being 50,000 to 600,000.

A crepe control agent is added to the wet end of a paper machine or sprayed on the paper or Yankee dryer to control adhesion of the paper, thus providing optimum crepe with a low level of web breaks. In addition, the crepe control agent provides a protective coating on the metallic Yankee surface which reduces drum surface wear thus reducing refinishing of the Yankee surface. Most wet strength agents provide some degree of crepe control, but non-wet strength crepe papers often require crepe control agents.

FIG. 1 shows a typical Yankee dryer, commonly made of steel, chrome alloy, or alloy cast iron. Typically, it is 12 ft. to 24 ft. in diameter, usually operated at a surface temperature of from 230° F. to 350° F. and a sheet speed of 250–5,000 ft./min.

Certain materials have been proposed in the past which provide controlled adhesion to the drying drum such that when the doctor blade is used to peel the dried paper web from the drum, the materials cause adhesion to the drum to an extent that creping takes place, but the drum is not fouled or the web broken. A disadvantage of most of these prior materials is that they confer wet strength and/or sizing to the paper, and accordingly the paper cannot be easily repulped nor does it disintegrate easily in sewage systems. One exception is found in U.S. Pat. No. 3,640,841, which describes a polyamine-polyamide which can be alkylated or quaternized, and is said to provide dry strength but not wet strength. U.S. Pat. Nos. 3,678,098, 3,694,393 and 3,702,799 disclose addition polymers, some of which are useful in the present invention, prepared from ethylenically unsaturated monomers having amine units, at least a portion of the amine units having been quaternized with epihalohydrin to provide water soluble polymers, the quaternary ammonium groups having one of two structures, depending upon the pH when cured.

In the drawing, the wet paper web 1 is fed to the hot surface of the drum of the Yankee dryer 3 by means of the felt 2. When the felt in the form of an endless belt is removed from the paper on the drum, the paper remains adhered to the drum until it reaches the point where the creping doctor blade 4 removes it from the drum. A cleaning doctor 5 is commonly present. The polymer solution may be applied at the wet end in the pulp prior to formation of the sheet, it may be sprayed on the web by means of a sprayer such as the sprayer 7, or it may be applied to the Yankee dryer surface by sprayer 6.

Typical pulps for forming tissue and towelling paper are bleached Kraft pulps in the form of a blend of softwood and hardwood fibers in the ratio of 30–60 to 60–30 by weight. The pulps are typically beaten lightly in a Valley beater or a Jordan refiner or other refiner to between about 500 and 660 CSF (Canadian Standard Freeness). The pH of the pulp slurry is suitably 4.5 to 8.0, preferably 5.5 to 6.0. Bleached sulfite or groundwood pulp, and blends of any of these pulps may also be used. Also, unbleached Kraft and semi-chemical pulps are useful.

Creping is a means of increasing basis weight (mass per unit area) by mechanically compacting paper in the machine direction. Usually this is accompanied by placing a doctor blade against a Yankee dryer in an on-machine operation. Many properties will be affected when measuring them in the machine direction. However, cross machine direction property curves appear to be normal. Several terms are used in crepe paper technology which relate directly to the creps itself. However, since the relationships are not simple, the following definitions may be helpful:

$BW_y$=basis weight at the Yankee dryer (mass per unit area)

$BW_r$=basis weight at the wind up reel (mass per unit area)

$BW_w$=basis weight at the rewinder (mass per unit)

$L_y$=length at the Yankee/$BW_y$ $L_r$=length at the wind up reel/$BW_y$ $L_w$=length at the rewinder/$BW_y$ $$\% \text{ crepe} = \frac{L_y - L_r}{L_y} \text{ or } \frac{L_y - L_w}{L_y} \times 100$$

(depending upon whether the sheet has simply been wound once or whether it has been through a back winding operation)

As can be seen from the above relationships the basis weight of the sheet at the Yankee prior to alteration by creping is the constant factor for any calculation and is the true basis weight of the sheet ($BW_y$). In actual mill practice, of course, the percent crepe is calculated as the difference between Yankee speed and winder speed divided by Yankee speed. Where a sheet is subsequently put through a rewinding operation some of the crepe will be pulled out and this is generally measured in terms of length differential rather than on speed differential.

In accordance with the present invention, wet strength and sizing are undesirable. There is an indication in U.S. Pat. No. 3,694,393 that the extent of quaternization of the amine used can be varied, see for example column 4, lines 49 through 59. Similarly there is disclosed in U.S. Pat. No. 3,702,799 at column 6, lines 10 through 19 that the amount of epihalohydrin used is equivalent to whatever proportion of the amine units that may be desired to quaternize, although no criticality is attached thereto. As a matter of fact, all of the examples of these patents involve the use of an excess quantity of epihalohydrin over that necessary to quaternize 100% of the amine units, which gives paper treated with the quaternized materials, or paper derived from pulp to which the materials have been added, the properties of wet strength and sizing.

In the present case, it has been found that in order to obtain a polymer which has good adhesion to the Yankee dryer surface to provide efficient creping, and yet have the ability to be repulped or to readily disintegrate in sewage systems, the extent of quaternization, if any, is such that the polymer has a relative high proportion of free amine groups, in a ratio to the quaternized amine groups, of between 20 to 0 and 1 to 1 on an equivalency basis. The same ratios hold as to the amine mer units XI with respect to the quaternary mer units IX plus X, infra.

In its broadest aspects the polymer contains units derived from an addition polymerizable ethylenically unsaturated amine-containing monomer, typically of the formula:

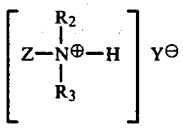

(XI)

as well as optional units of one or more of the formulae:

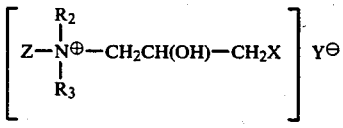

(IX)

and

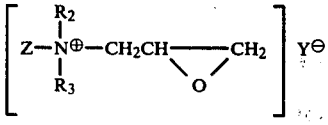

(X)

wherein $R_2$ and $R_3$ are H or lower alkyl having 1 to 4 carbon atoms, examples being methyl and tertiary butyl, or together may form a cycloaliphatic or cycloaromatic ring, examples being pyridyl, oxazoline, and the like, and Z is an addition polymer chain. Suitable amine-containing monomers which individually are referred to as monomer VII which are useful to give water solubility to the polymer and provide, in some cases, quaternary groups, are those such as set forth in U.S. Pat. No. 3,671,472, incorporated herein by reference. Specific examples of preferred materials include dimethylaminomethyl(meth)acrylate, diethylaminoethyl(meth)acrylate, tertiary butyl aminoethyl(meth)acrylate, N-methyl diallyl amine, vinylbenzyl dimethylamine, oxazolidinyl ethyl(meth)acrylate, and aminoethyl(meth)acrylate. Other examples of the compounds to yield the amine groups are:

N-(3-dimethylamino)propyl methacrylamide
N-(β-dimethylamino)ethyl acrylamide
N-(β-dimethylamino)ethyl methacrylamide
10-aminodecyl vinyl ether
8-aminooctyl vinyl ether
Diethylaminohexyl methacrylate
Diethylaminoethyl vinyl ether
5-aminopentyl vinyl ether
3-aminopropyl vinyl ether
2-aminoethyl vinyl ether
2-aminobutyl vinyl ether
4-aminobutyl vinyl ether
Dimethylaminoethyl vinyl ether
N-(3,5,5-trimethylhexyl)aminoethyl vinyl ether
N-cyclohexylaminoethyl vinyl ether
N-methylaminoethyl vinyl ether
N-2-ethylhexylaminoethyl vinyl ether
Vinyl β-dimethylaminopropionate
3-dimethylamino-2,2-dimethyl-propyl methacrylate
Methacrylate of N-hydroxyethyl-2,4,4-trimethyl-pyrrolidine
1-dimethylamino-2-propyl methacrylate
β-Morpholinoethyl methacrylate
4-(β-acryloxyethyl)-pyridine
3-(β-methacryloxyethyl)-pyridine
β-Pyrrolidinoethyl vinyl ether
5-aminopentyl vinyl sulfide
β-Hydroxyethylaminoethyl vinyl ether
(N-β-hydroxyethyl-N-methyl)aminoethyl vinyl ether
Hydroxyethyldimethyl(vinyloxyethyl)ammonium hydroxide
2-vinylpyridine
3-vinylpyridine
4-vinylpyridine
2-methyl-5-vinylpyridine
5-methyl-2-vinylpyridine
4-methyl-2-vinylpyridine
2-ethyl-5-vinylpyridine
2,3,4-trimethyl-5-vinylpyridine
3,4,5,6-tetramethyl-2-vinylpyridine
3-ethyl-5-vinylpyridine
2,6-diethyl-4-vinylpyridine
2-isopropyl-4-nonyl-5-vinylpyridine
2-methyl-5-undecyl-3-vinylpyridine
3-dodecyl-4-vinylpyridine
2,4-dimethyl-5,6-dipentyl-3-vinylpyridine
2-decyl-5-(α-methylvinyl)-pyridine
3-(4-pyridyl)-propyl methacrylate
2-(4-pyridyl)-ethyl methacrylate
2-(4-pyridyl)-ethyl acrylate
3-methacryloxypyridine The preferred water soluble addition polymer is derivable from the aforementioned ethylenically unsaturated addition polymerizable amine-containing monomers and in some cases including compounds of the following formulas:

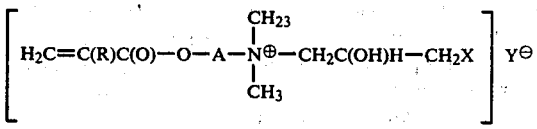

(V)

-continued (VI)

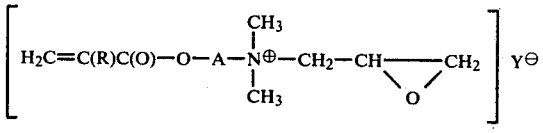

wherein

R is hydrogen or methyl,

X is iodine, bromine, or chlorine,

A is a ($C_2$–$C_6$) alkylene group having at least two carbon atoms in a chain between the adjoined O and N atoms or A may be a polyoxyethylene group of the formula:

$$-(CH_2CH_2O)_xCH_2CH_2-$$

wherein x is from 1 to 11, and

Y is an anion, such as a halogen ion (Cl-, Br-, or I-) or the anion of any other acid, such as nitrate, phosphate, acid phosphate, sulfate, bisulfite, methyl sulfate, carboxylate, sulfonate, sulfamate, acetate, citrate, formate, propionate, gluconate, lactate, glycolate, oxalate, acrylate, and α-methacryloxyacetate.

Preferably, Y is the anion of an acid having an ionization constant ($pK_a$) of 5.0 or less, i.e., a dissociation such that the hydrogen ion concentration is at least $10^{-5}$. When used, the V and VI compounds are present in an amount depending on pH. It is all V at low pH, all VI at high pH. The polymer must contain units of the amino monomer (VII), optionally with at least one other monoethylenically unsaturated monomer VIII having a group of the formula:

(VIII)

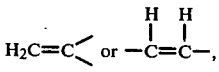

the quantity of the monomer being such that the polymer is water soluble when converted into an organic or inorganic acid salt of the amino component of the polymer. Said paper is repulpable by virtue of the water solubility of the salt. The relative quantities of monomers V, VI, VII, and VIII are variable with the proviso that the above noted ratio of free amine groups to quaternized amine groups be adhered to. The quantity of amine monomer, in the form of the preferred monomer salt III, infra, is 10% to 100% by weight, with the above proviso as to extent, if any, quaternization.

The preferred polymer of the present invention may be considered to be a polymer having units of the formula:

(XIV)

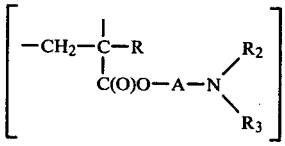

optionally, and at times preferably with units of the formulae:

(I)

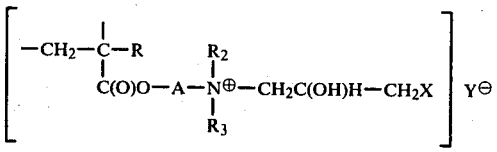

(II)

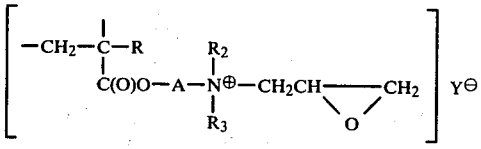

and usually with units derived from monomer VIII, supra, where the symbols have the meanings given above.

To obtain quaternized monomers useful in the present invention, a salt of a basic ester for instance of the formula:

$$H_2C{=}C(R)-C(O)O-A-N(CH_3)_2HY \quad \text{(III)}$$

is reacted under acid conditions with an epihalohydrin of the formula:

(IV)

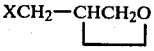

wherein A, R, N, X, and Y are as defined above. Alternatively, the ester salt of Formula III is reacted with an alkylene oxide, such as ethylene oxide or propylene oxide to afford (XII)

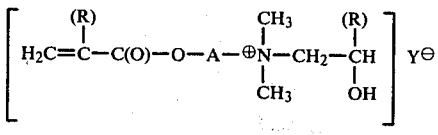

wherein A, R and Y are as above. The reaction may be effected at from room temperature to about 80° C. Generally, the procedure should be controlled to prevent the temperature exceeding about 80° C., and preferably to avoid temperatures exceeding about 50° C. The reaction is most conveniently carried out in aqueous media, preferably water itself. The starting salts (III) and the epihalohydrin (IV) are adequately water-soluble to make water entirely suitable as the reaction medium. The amount of epihalohydrin employed is preferably less than 130% of the stoichiometric amount. The aqueous medium may contain an auxiliary water-miscible solvent when A is an alkylene group of 4 or more carbon atoms. No catalyst is needed for the reaction. It is, however, essential that the pH be maintained on the acid side during the reaction to prevent undesirable side reactions. The reaction is rapid even when started at room temperature. Its completion can be readily determined by following the drop in amine titre (amine content in milliequivalents per gram of solution) as the amine group is quaternized. Generally, the addition of epihalohydrin or alkylene oxide to the aqueous starting salt solution is made at as rapid a rate as is consistent with the control of the temperature in the reaction system. A polymerization inhibitor may be present in the reaction medium. Examples of inhibitors include the monomethyl ether of hydroquinone, hydroquinone, and phenothiazine. The amount of inhibitor may be from 0.01% to 1% based on the weight of starting salt (III). The carbon atoms of the A group of Formula I may be straight chain or may be branched-chain. However, it is preferred that the carbon atom of A attached directly to the nitrogen atom has at least one hydrogen substituent to ensure that the reaction is not sterically hindered. One of the hydrogen atoms in one or more or all of the ethylene groups of the polyoxyethylene group representing A may be replaced by a methyl group.

The epihalohydrin (IV) may be epiiodohydrin or epibromohydrin, but is preferably epichlorohydrin. Similarly, the salt of the monomer (III) may be any of the acid salts such as hydroiodide or hydrobromide, but is most preferably the citrate or sulfate, which permit high polymer solids contents, and less preferably the acetate, hydrochloride, or the salt formed with nitric acid. One or both of the methyl groups on the nitrogen atom may be replaced by cyclohexyl or another alkyl group, but the compound of Formula III in which these groups are both methyl reacts so much more rapidly with the epihalohydrin than that in which they are ethyl that it is believed the dimethyl compound is the best one from a practical standpoint.

The resulting monomeric compounds which may be used to prepare the polymers of this invention are compounds having formulae V and VI given above. They are obtained in high yield (over 90%) in aqueous reaction medium. The products of the reaction may be concentrated or even isolated from the reaction medium in which they are dissolved by vaporization of the water, preferably under vacuum. However, they can be stored in the form of their aqueous solutions as obtained. Of course, monomers of formula III may be polymerized and the polymer then partially quaternized.

The products are addition polymerizable and for this purpose, their aqueous solutions may be used directly. Any known polymerization initiator of free radical type effective in aqueous systems can be used. Examples are tert-butyl hydroperoxide, ammonium persulfate, and alkali metal persulfates, such as those of sodium or potassium. They are used at the customary dosage of 0.1 to 2% by weight, based on monomer weight. They may be used with sodium hydrosulfite or other reducing agents in redox systems. The polymerization may be effected by radiation.

The amine containing monomers, with or without the quaternary ammonium salt monomers may be copolymerized with other polymerizable ethylenically unsaturated monomers, especially by emulsion polymerization procedures, using the initiators or redox systems just mentioned in conjunction, if desired, with suitable emulsifiers of nonionic or cationic type. As emulsifiers, there may be used tert-octyl- or tert-nonylphenoxy-polyethoxy ethanols having from about 10 to about 50 or more oxyethylene groups, octadecylamine sulfate, cyclohexyldiethyl(dodecyl)amine sulfate, octadecyltrimethylammonium bromide, polyethoxy amines or mixtures of two or more such emulsifiers.

Any addition polymerizable ethylenically unsaturated monomer having a group $$H_2C{=}O> \text{ or } -CH{=}CH-$$

may be used for such copolymerization under conditions such that the polymerization medium is maintained at an acid condition, preferably at a pH of not over 6, preferably 1–3. Examples of monoethylenically unsaturated monomers include $\alpha,\beta$-monoethylenically unsaturated acids, such as acrylic acid, methacrylic acid, itaconic acid, methacryl-oxy-propionic acid, maleic acid, and fumaric acid; vinyl esters of ($C_1$–$C_{18}$)aliphatic acids, such as vinyl acetate, laurate, and stearate; esters of acrylic acid or methacrylic acid with ($C_1$–$C_{18}$) alcohols, including ($C_1$–$C_{18}$) alkanols, benzyl alcohol, cyclohexyl alcohol, and isobornyl alcohol, such as methyl acrylate or methacrylate, ethyl acrylate or methacrylate, butyl acrylates or methacrylate, 2-ethylhexyl acrylate or methacrylate, octadecyl acrylate or methacrylate, hydroxyethyl methacrylate, hydroxypropyl methacrylate, methoxyethoxyethyl acrylate or methacrylate, ethoxyethoxyethyl acrylate or methacrylate, methoxyethyl acrylate or methacrylate, ethoxyethyl acrylate or methacrylate; vinyl aromatic hydrocarbons including styrene, isopropenyltoluene, and various dialkyl styrenes; aerylonitrile, methacrylonitrile, ethacrylonitrile, and phenylacrylonitrile; acrylamide, methacrylamide, ethacrylamide, N-methylol acrylamide, N-monoalkyl and N-dialkyl acrylamides and methacrylamides, including N-monomethyl, -ethyl, -propyl, -butyl, and N-dimethyl, -ethyl, -propyl, -butyl, and the like, alkaryl amides, including N-monophenyl- and -diphenylacrylamides -methacrylamides, and the like; vinyl ethers, such as butylvinyl ether; N-vinyl lactone such as N-vinyl pyrrolidone; and olefins, such as ethylene, fluorinated vinyl compounds, such as vinylidene fluoride; $\beta$-hydroxyethylacrylate or methacrylate or any of the hydroxyl-containing or amine-containing monomers mentioned in columns 2 and 3 of U.S. Pat. No. 3,150,112 which patent is hereby incorporated by reference; vinylchloride and vinylidene chloride; alkyl vinyl ketones; including methyl vinyl ketone, ethyl vinyl ketone, and methyl isopropenyl ketone; itaconic diesters containing a single ethylenic grouping, including the dimethyl, diethyl, dipropyl, dibutyl and other saturated aliphatic monohydric alcohol diesters of itaconic acid, diphenyl itaconate, dibenzyl itaconate, di(-phenylethyl)itaconates; allyl, and methallyl esters of saturated aliphatic monocarboxylic acid including allyl and methallyl esters of saturated aliphatic monocarboxylic acid, including allyl and methallyl acetates, allyl- and methallyl propionates, allyl- and methallyl valerates; vinylthiophene; 4-vinylpyridine; vinyl pyrrole; and ethylenically unsaturated monomers containing a quaternary ammonium group, such as methacryloxyethyltrimethyl ammonium chloride and acryloxyethyltrimethyl ammonium chloride.

The proportion of (a) unsaturated amines, their salts, and the optional quaternaries, calculated as the free amines, relative to (b) the monomers having $H_2C{=}C<$ or $-CH{=}CH-$ structures is 10–100 of (a) with 0–90 (b), preferably 10–50 (a) with 50–90 (b), by weight, with the total being 100. An example is 30 (a) with 70 (b). At the lower levels of amine, or its salt, it may be necessary to include hydrophilic monomers among those given above, well known to those skilled in the art, to obtain water solubility.

Preferred polymers are those in which the (a) amine monomer, its salt, and the optical quaternary monomers, each calculated as the free amine, and (b) the monomers having one or more of the $H_2C{=}C<$ and $-CH{=}CH-$ structures are present in the relative amounts, by weight, of 10–90 (a) with 10–90 (b), preferably 20–40 (a) with 60–80 (b), the total of (a)+(b) being 100. It will be noted that the examples fall with the preferred ranges.

Still more preferred, are polymers in which (a) the amine, its salt, and optionally including its quaternary, is an amino alkyl ester of at least one of acrylic acid and methacrylic acid, the monomer (b) is at least one of an ester, amide, or nitrile of the $\alpha,\beta$-ethylenically unsaturated carboxylic acids, vinyl aromatic hydrocarbons, vinyl ethers, vinyl lactones, fluorinated vinyl compounds, vinyl and vinylidine halides, vinyl alkanol esters of alkanoic acids, unsaturated ketones, and allyl compounds, and in which the relative amounts of (a) and (b) are 10–50 (a) with 50–90 (b). Most preferably, at least a major proportion of monomer (b) is at least one of an ester of acrylic acid and methacrylic acid.

The monomers of Formulas V and VI, when used, in the preferred method, are directly useful for copolymerization, the resulting copolymer containing 0.2 to 5% by weight of the quaternary ammonium compound.

The polymers of the invention are used for the controlled adhesion of a paper web (bathroom or facial tissue, or absorbent towelling) to facilitate creping by doctoring the web from a hot metal drying surface, e.g., a Yankee dryer. A small amount in the range of 0.2 to 5% or more by weight of the polymeric compound based on dry fiber weight, may be mixed into the paper pulp in the beater or shortly before, or after the pulp leaves the beater. The effect obtained in the dry paper produced therefrom varies in dependence on the pH of the system. If the pulp is at a pH of less than 7, the paper obtained shows a sizing effect. If the pulp is neutral or alkaline or is rendered alkaline, such as at a pH of 8 to 10, at some point prior to drying of the formed sheet, increased wet strength is also obtained, a result not desired in accordance with the present invention, especially when quaternary units are present.

A preferred alternative method of preparing the polymers of the present invention, if partially quaternized, is to react an epihalohydrin with a polymer containing from 10% to 100% by weight of an amine salt of Formula III supra. Such polymer may be obtained by polymerizing the amine salt of Formula III directly or by polymerizing the corresponding amine in free base form and then neutralizing it with an acid to form the salt of the amine polymer. Numerous methods of polymerizing (including copolymerizing within the meaning of this term) the amine salts of Formula III and the corresponding amines in free base form are well known and any of these methods may be used. Conventional emulsion or suspension, bulk, and solution polymerization techniques may be employed. Any of the comonomers listed above for copolymerization with the quaternary ammonium compound of Formula V may be used as comonomers with the amine salts of Formula III or the corresponding amine in free base form.

The reaction of the epihalohydrin and the polymer salt may be carried out in the same way and under the same conditions as that of the epihalohydrin and the monomer of Formula II. The polymer may be dissolved in water or it may be present in the form of an aqueous latex obtained by emulsion polymerization. The epihalohydrin is used, if at all, in the stoichiometric equivalent proportion to convert the proportion of amine units in the polymer to quaternary ammonium units to an extent of 20/1 to 1/1, on an equivalency basis of amine to quaternary salt, as noted above.

As suggested above, reaction of the amine salt polymer (whether homopolymer or copolymer) with the epoxy compound provides a polymer having units containing quaternary ammonium groups of the Formulas I and II given above. The relative amounts of I and II will depend on the exact reaction conditions but, in a typical case, these units will be present largely in the I form. Lowering of the pH apparently reduces the proportion of II. At pH values of 6 or less, the propensity for gelation attributable to the glycidyl group of II is inhibited (or possibly completely lacking because of absence or almost complete absence of II groups at pH $<3$) whereas raising the pH to neutral or alkaline conditions results in rapid curing of the copolymer, even at room temperature, to an insoluble condition, the higher the pH and concentration of the polymer the more rapid the curing. Apparently, the groups I are converted to II groups when the pH is made alkaline and alkali-catalyzed transformations of the glycidyl groups can cause cure and insolubilization of the polymer. In the present case, the pH must be 6 or less, preferably 3–5.

The water-soluble copolymers containing units of Formula I whether or not units of Formula II are also present therein can be made by copolymerizing monomers V, III, and VIII, with or without VI or by copolymerizing monomers III and VIII, then partially quaternizing III. Included are copolymers of cationic character having up to 25% by weight of acid-containing units (such as those of acrylic acid or methacrylic acid) therein at the time of application to the pulp or paper. In general, optimum results are obtained when the cationic copolymer contains about 0 to 5% by weight of acid-containing units. The introduction of the acid groups into the polymer may be accomplished by (1) direct copolymerization or by (2) hydrolysis of ester units in the copolymer or monomeric ester units during polymerization, quaternization, or other known methods. Alternatively, part of the acid groups may be introduced by (1) and part by (2). For example, an acid salt of a dialkylaminoalkyl acrylate may be copolymerized, with an acid, such as acrylic acid, to produce a copolymer containing up to 25% by weight of acid and the balance of the aminoalkyl acrylate, the copolymer being subsequently quaternized with an epihalohydrin.

Copolymers of a monomer of Formula I and/or II are of value in providing paper with good creeping, although as noted elsewhere herein, no quaternary units at all are needed for good results. These water-soluble linear copolymers have molecular weights in the range of about 25,000 to 1,000,000 or more and may be made by the direct polymerization of the quaternary monomers or their salts. Alternatively, a homopolymer of dimethylaminoethyl acrylate or methacrylate may be made and this amine-containing polymer may be simultaneously quaternized with the components of a mixture of epichlorohydrin and methyl chloride, to provide quaternary units in the copolymer.

When polymers in the lower molecular weight range are desired, the polymerization of the amine or its salt, optionally with the other monomers noted, may be effected at elevated temperatures, e.g., 40° to 60° C. or higher in organic solvents using conventional initiator systems. In emulsion polymerizations using initiators such as ammonium persulfate with or without sodium hydrosulfite, mercaptans or other chain transfer agents give the lower molecular weights. The higher molecular weight polymers may be obtained at lower temperatures, such as 5° to 10° C., in organic solvents and using concentrations of 60% or more, with dilution to facilitate handling as polymerization progresses, or if in emulsion polymerization, omitting chain transfer agents, and using low initiator levels.

To prepare paper, the polymers hereinabove defined may be applied to the paper or cellulosic web by the conventional methods used for the purpose, e.g., coating, dipping, brushing, spraying, or by wet end addition, etc. The paper used may have a basis weight of 5 to 100 lbs., preferably 10 to 30 lbs. per 3,000 ft.$^2$ (8.13 to 162.5 g/m$^2$, preferably 16.25 to 48.75 g/m$^2$). The amount of polymer applied to the paper will be an effective amount preferably varying within the range of about 0.05% to 1%, more preferably 0.05% to 0.5% (weight) pick-up, bone dry basis, depending upon the particular polymer and paper combination used.

The wet tensile strength determined by the TAPPI method in accordance with the present invention is between 0.2 and 1.0 lb./sq. in., preferably 0.2 and 0.6 lbs./sq. in.

The adsorbency in seconds for 0.1 milliliters of water to be absorbed, placed on a finished paper sheet in accordance with the invention, is between 30 and 1,000 seconds, with between 30 and 300 seconds being preferred. Where absorbency is too low (i.e., the time to absorb the drop of water is too long) at a given resin level, the level can be lowered if adherency is still satisfactory.

Unless otherwise indicated herein, parts and proportions are by weight.

EXAMPLE 1

(a) Preparation of Amine-Containing Water Soluble Emulsion Polymer

A 3-liter round bottom flask is fitted with a stirrer, reflux condenser, and nitrogen inlet tube. The flask is charged with 1,500 g. of deionized (DI) water and sparged with nitrogen for one hour. Then, 41.4 g. of Triton X-405 (OPE-40) (70%) and 35.5 g. of 25% sodium lauryl sulfate are charged to the flask. After stirring 15 minutes, 336 g. of methyl methacrylate (MMA) is added in one portion, and the mixture is stirred 10 minutes. A freshly combined mixture of 4.5 g. of 0.1% ferrous sulfate heptahydrate and 6.0 g. of 0.1% "Versene" are then added, followed by 144 g. dimethylaminoethyl methacrylate (DMAEMA). Five minutes after the addition of the DMAEMA, at a kettle temperature of 24° C., 2.4 g. of isoascorbic acid in 97.5 g. of water is added. Within one minute, 3.42 g. of 70% t-butyl hydroperoxide (t-BHP) is added. In two minutes, the temperature reaches 30° C. and the exothermic polymerization gives a peak temperature of 55° C. within 8 minutes. Fifteen minutes after the temperature peaks, 0.24 g. of isoascorbic acid in 15 ml. of water is added, followed by 0.34 g. of t-BHP as a chaser to eliminate residual monomer. Thirty minutes after addition of the chaser, the emulsion is sampled.

Found: solids, 25.2%; pH, 8.5; titer, 0.385 meq/g. at pKa 5.9 and 0.030 meq/g. at pKa 9.4.

An 800 g. portion of the polymer emulsion is diluted with 1600 g. of water and heating started. At 50° C., 20.25 g. of acetic acid is added, and the polymer becomes solubilized.

Found: solids 8.4; pH 5.3; viscosity 550 cps. (spindle 3, 60 RPM); titer 0.277 meq/g.

(b) Quaternizing Polymer of Example 1a

To 1520 g. of the solubilized copolymer, 3.92 g. of epichlorohydrin is added at 70° F.; the temperature is maintained at 70° F. for 3 hours. The resin is then cooled and characterized.

Found: solids, 9.3; viscosity, 850 cps; pH, 5.2; titer, 0.249 meq/g.

Equivalents of amine to quaternary groups are 4/1.

EXAMPLE 2

Preparation of Low Molecular Weight Amine-Containing Polymer and its Quaternization The procedure outlined above is followed except that 4.8 g. of bromotrichloromethane chain transfer agent is added along with the methyl methacrylate charge. The emulsion polymer has a pH of 8.0, a solids content of 25.6%, a titer of 0.407 meq/g. at pKa 5.9 and 0.03 meq/g. at pKa 9.4.

After solubilization with acetic acid as described above, the polymer solution has 8.7% solids, pH 5.3, viscosity 230 cps. and a titer of 0.275 meq/g. After partial quaternization with epichlorohydrin, the crepe-control resin has:

solids, 9.3%; viscosity, 250 cps; pH, 5.2; titer, 0.245 meq/g.

The use of excess catalyst is also useful to reduce molecular weight of the final polymer, as is the use of high temperature solution polymerization, as is well known to those skilled in the art.

EXAMPLE 3

(a) Preparation of Solution Polymer-Containing Amine Groups

A 2-liter round bottom flask is fitted with a stirrer, reflux condenser, nitrogen inlet tube and an additional funnel. Six hundred grams of toluene is charged to the flask and heated to 95° C. Then, at a kettle temperature of 95° C. a mixture of 630 g. of methyl methacrylate, 290 g. of dimethylaminoethyl methacrylate (93% purity) and 5.4 g. of azobisisobutyronitrile are added over three hours. Finally, 3.6 g. of azobisisobutyronitrile in 300 g. of toluene is added over two hours. The polymer solution is then cooled; solids content of the solution is 49.1%; total amine titer is 0.991 meq/g. An equivalent of acetic acid based on amine titer is added, and toluene is removed by distillation while water is continually added to reduce solids to about 25% solids (actual amine titer is 0.42 meq/g.).

(b) Preparation of Quaternized Amine Polymer—25% of Amine Equivalent Quaternized To 3,000 g. of this aqueous, toluene-free solution 23.3 g. of epichlorohydrin is added. After 24 hours at room temperature, the amine titer is 0.31 meq/g. The pH of the sample is reduced to 4.5 with nitric acid, excess water is added, and any residual epichlorohydrin removed on a rotary evaporator. The final resin contains 7.2% solids, has a pH of 5.0, and a viscosity less than 15 cps.

Equivalents-3/1.

EXAMPLE 4

Polymer From Quaternized Monomer

Place the following materials into 3 liter flask in the order listed and warm to 40° F.

3,000 g. Deionized Water
10 g. Triton X-405 (70% T.S.)
10 g. SLS (28% T.S.) (sodium lauryl sulfate, 28% aqueous)
144 g. MMA (methyl methacrylate)

Stir the above and purge emulsion with nitrogen for 5 minutes, then blank emulsion with nitrogen. Add 3.2 grams of crystalline iso-ascorbic acid, "Versene"-$FeSO_4$, and 76 grams of dimethylaminoethyl methacrylate (DMAEMA) in rapid succession in the order given. Stir with extreme vigor for 1 minute and initiate with 4 ml. of t-butyl hydroperoxide.

Polymerization with exotherm for 40° C. (initial temperature) to 45° C. (peak temperature) giving approximately a 5° C. exotherm. After peak temperatures have been achieved, allow polymerization to continue an additional 20 minutes, then add the following materials in the order given: acetic acid, 30 g.; methyl methacrylate 36 g.; DMAEMA quaternized with epichlorohydrin, solubilized with nitric acid, 14 g. of 25% sulfuric acid; and iso-ascorbic acid, 0.6 g. Stir vigorously for 1 minute, then add 1.0 ml. of t-butyl hydroperoxide. An exotherm of approximately 2° C. is observed. Chase residual monomer with 0.4 g. of crystalline sodium sulfoxylate formaldehyde and 0.5 ml t-BHP. Stirring is continued for approximately 20 minutes after chase addition.

Properties:
Solids: 8–15%
Light Scatter: 16% (as is)

EXAMPLE 5

Preparation of Polymer Outside of the Present Invention

A 2-liter flask equipped with stirrer, reflux condenser, nitrogen, inlet tube and two addition funnels is charged with 476 g. of tap water and warmed to 75° C. while being sparged with nitrogen. When the temperature levels off at 75° C., 3 ml. of 0.1% $FeSO_4.7H_2O$ in water is added. The addition funnels are charged with (A) a solution of 630 g. of a 34.8% solution of monomer V and (B) 30 g. of methyl acrylate containing 1.78 g. of t-butylhydroperoxide. At 75° C. 0.62 g. of "Formopon" is added to the flask, and the two addition funnels are programmed for two hour additions. A second "Formopon" charge is added after 1 hour of monomer feed. When monomer addition is complete, the reaction is maintained at 75° C. for one hour. The cooled solution has a pH of 3.8, a solids content of 23.0%, and a Brookfield viscosity of 23 centipoises.

EXAMPLE 6

To 4,000 g. of the nitric acid salt of the unquaternized copolymer of methyl acrylate and dimethylaminoethyl methacrylate (DMAEMA) prepared as described above in Example 5 in a stirred 5-liter flask is added 60 g. of 20% NaOH; the pH rises to 5.5. AT 55° C., 191.9 g. of ethylene oxide (0.95 g. equivalents based on amine titer) is added over 30 minutes. After 2 hours at 60° C., 0.0875 meq/g. amine remains (theory for no quaternizing action is 1.08 meq/g.). Then, 80 g. ECH (0.20 eq.) is added in one portion. After 2 hours more at 60° C., no amine can be detected by titration. The solution is stripped at reduced pressure to remove residual epichlorohydrin and dilute nitric acid is added to reduce the pH to 1.0. The resin has a viscosity of 80 centipoises at 35.6% solids. This polymer is also outside of the present invention.

EXAMPLE 7

To 3,440 g. of the copolymer of methyl acrylate and dimethylaminoethyl methacrylate hydronitrate prepared as described in Example 6 is added 47 g. of 20% NaOH to raise the pH to 5.5. Then, at 55° C., 47.15 g. (0.13 eg. on amine titer) of epichlorohydrin is added. After 2 hours at 60° C., an amine content of 0.97 meq/g. (theory 1.11 meq/g., or 12.5% quaternization) is observed. Dilute nitric acid is added to reduce the pH to 1.0. The final resin has a viscosity of 45 centipoises at 31.3% solids.

The molecular weight of the polymers of the examples are within the range of about 25,000–750,000.

EXAMPLE 8

Creeping Procedure

A blend of bleached Kraft hardwood and softwood pulp 50/50 is defibered at 3% solids in a "Hydrapulper". This is then refined in a Jordan for 30 minutes to give a CSF of 590 (30" Williams). The pulp is pumped to the stock tank where it is diluted to 1% consistency, the pH being about 6.6. The paper machine is operated at 150'/min. with the windup set to give 16% crepe on a 39 g/m$^2$ basis weight flat sheet. The Yankee dryer is adjusted to about 250° F. measured temperature on the surface. The various crepe control agents are added after the flow regulator in-line to the machine chest. The polymers are in the form of the nitric or acetic acid salt, and are prepared according to the procedure of Examples 1, 2, and 3. The polymers are added at 0.15% polymer solids on bone dry pulp solids. Samples of both creped and uncreped paper are obtained for evaluation. Observations of crepeability, release, coating of Yankee dryer, foam, etc., are made after 30 minutes running to allow equilibration of conditions.

Lab testing consists of wet tensile run on the Scott IP-4 tensile tester, and absorbency is tested by recording the time for 0.1 ml. of deionized water to be absorbed. The results are listed in Table I.

TABLE I

| Run | Variant | Yankee Adhesion(1) (Rating 1–5) | Wet(2) Tensile Strength (lbs./sq.in.) | Absorbency(3) | Foam(4) |
|---|---|---|---|---|---|
| a. | No resin added | None | 0.5 | 160 | None |
| b. | 25% Quat.* - 0.6% Initiator | 2.5 | 0.6 | 150 | Slight |
| c. | 40% Quat. - 0.6% Initiator | 2.6 | 0.5 | 210 | Slight |
| d. | 100% Quat. (ECH) | 3.0 | 1.2 | 465 | None |
| e. | 12.5% Quat. (ECH) 87.5% Quat. (EO) | 3.0 | 0.4 | 290 | None |
| f. | 12.5% Quat. (ECH) | 3.0 | 0.5 | 380 | V. Slight |
| g. | 20% Quat. (ECH) - (High Mol. Wt.) | 2.6 | 0.5 | 115 | Slight |
| h. | 22% Quat. (ECH) - (Mod. Mol. Wt.) | 2.8 | 0.5 | 130 | Slight |
| i. | 25% Quat. (ECH) - (Low Mol. Wt.) | 2.5 | 0.5 | 250 | V. Slight |

TABLE I-continued

| Run | Variant | Yankee Adhesion[1] (Rating 1-5) | Wet[2] Tensile Strength (lbs./sq.in.) | Absorbency[3] | Foam[4] |
|---|---|---|---|---|---|
| j. | 25% Quat. - 0.25% Initiator[5] | 2.2 | 0.6 | 290 | Slight |
| k. | 48% Quat. - 0.25% Initiator[5] | 2.3 | 0.0 | 300 | Slight |

*On an equivalency basis, the % of amine groups quaternized. ECH is epichlorohydrin. EO is ethylene oxide.
[1]Adhesion (1-5) 1 = least adhesion.
[2]Sheet soaked in water.
[3]Seconds to absorb about 0.1 ml. water
[4]Observed in machine chest.
[5]Azobisisobutyronitrile.

In the foregoing Table, run d is a polymer of 80 parts dimethylaminoethylmethacrylate, and 20 parts of methyl acrylate, as are runs e and f. The remainder of the runs utilize a polymer having 70 parts of methyl methacrylate and 30 parts of dimethylaminoethylmethacrylate. Runs d, e, and f are neutralized with nitric acid, and the remainder of the runs with acetic acid.

Runs b, c, j, and k are prepared in toluene and transferred to water without an emulsifier, the toluene being removed. Runs g, h, and i are prepared by emulsion polymerization as in Example 1, the latter two having respectively 1% and 3% bromotrichloromethane chain transfer agent in the recipe in order to lower the molecular weight.

In Run g, the same procedure as in Example 1 is used, but 4.9 grams (0.25 equivalents) of epichlorohydrin is added in the quaternization step. Run h is prepared similarly to Example 2 but quaternization is with 0.22 equivalents of epichlorohydrin. Run i follows the procedure of Example 1, but 14.4 grams of bromotrichloromethane is added along with the methyl methacrylate charge. Quaternization of the product used in Run i is conducted on the acetic acid salt using 0.25 equivalents of epichlorohydrin. The polymer of Run c is prepared similarly to Example 3, but using 46.6 grams of epichlorohydrin in the quaternization step. Run j is prepared similarly to the product of Example 3, but 2.3 grams of azobisisobutyronitrile is used, and in the quaternization step, 0.25 equivalents of epichlorohydrin is used. In Run k the polymer preparation is as in Run j, but utilizing 0.48 equivalents of epichlorohydrin.

The polymers of Runs b, d, e, f, g, and h are prepared by the methods of Examples (3a), 5, 6, 7, (1b) and 2 respectively.

EXAMPLE 9

This example illustrates the technique of saturating preformed paper sheets with the polymer solution, drying them, and then testing them as in the preceding example. The procedure utilized is described hereinbelow.

A pulp furnish of 60% softwood/40% hardwood, by weight, pulp is beaten at 2.5% consistency to 600 mls. C.F. on the laboratory Valley beater and is diluted to 1% consistency for handsheet production. A two quart sample of the 1% slurry (20 grams pulp) is added to the disintegrator, treated with the resin (for use in Example 10—no resin in slurry for Example 9), and agitated for four minutes. The pH of the slurry is adjusted to 6.0 with $H_2SO_4$. The slurry is then transferred to the proportioner and diluted to 0.125% with water and adjusted ot pH 6.0.

Handsheets are made on a Noble and Wood papermaking equipment using one quart aliquots to yield a basis weight of 30 gm/m$^2$. Sheets are passed between felts at 5 lbs. pressure and then dried on a drum drier at 200° F. for 130 seconds and conditioned overnight at 72° F. and 50%.

For saturation, blank handsheets are made at a basis weight of 30 gm/m$^2$ as base stock for saturation. The dilution water is pH 6.0 throughout the papermaking procedure. The saturation baths for levels of 0.2%, 0.4% and 0.6% add-on are made up at 0.1%, 0.2% and 0.3% solids. The wet pick up is 200%. Due to the weakness of the base stock, it is necessary to support the handsheet with a polyethylene sheet when running it through the rolls. Samples are dried on a hot plate at 200° F. for 130 seconds and conditioned overnight at 72° F. and 50% relative humidity.

The polymer of Example (1b) gives the following results:

| % Polymer in Sheet | Absorbency |
|---|---|
| 0.2% | 600+ |
| 0.4% | 600+ |
| 0.6% | 600+ |

The results using the unquaternized polymer of Example (1a) gives the following results:

| % Polymer in Sheet | Absorbency |
|---|---|
| 0.2% | 150 |
| 0.4% | 227 |
| 0.6% | 210 |

A blanket sheet with no polymer had an absorbency of 40, "absorbency" being as defined above.

It appears that utilizing the saturation procedure, the quaternized polymer of Example (1b), confers poorer absorbency than the unquaternized polymer. However, at lower levels than noted, such below about 0.2%, more satisfactory absorbency is achieved.

EXAMPLE 10

This example illustrates that the polymer is essentially completely picked up when wet end inclusion of the polymer is used.

The pulp resin addition and sheet formation are as described in Example 9.

A one quart aliquot of treated slurry (0.2% polymer on solids) is added to the deckel box and diluted with pH 6.0 tap water. A handsheet is formed and the drainage water is retained in the white water chest to be recycled as dilution water for the subsequent handsheets. No additional water is added to the system in the formation of the series of fifteen recycled handsheets. Either polymer is excellent in wet end use.

Handsheets are pressed and dried in the normal manner and conditioned overnight at 72° F. and 50% relative humidity. The results are as follows:

TABLE II

Recycling Experiments and Effects on Absorbency

| Sheet No. | 0.2% Polymer of Ex. (1a) Absorbency sec./0.1 ml. $H_2O$ | 0.2% Polymer of Ex. (1b) (Unquated) Absorbency sec./0.1 ml. $H_2O$ |
|---|---|---|
| 1 | 60 | 40 |
| 2 | 130 (Anomalous Result) | 48 |
| 3 | 85 | 52 |
| 4 | 80 | 60 |
| 5 | 75 | 56 |
| 6 | 76 | 55 |
| 7 | 76 | 56 |
| 8 | 72 | 60 |
| 9 | 65 | 64 |
| 10 | 63 | 57 |
| 11 | 70 | 55 |
| 12 | 63 | 55 |
| 13 | 65 | 56 |
| 14 | 65 | 56 |
| 15 | 63 | 54 |

EXAMPLE 11

This Example illustrates the utilization of a wide variety of solubilizing acids, varying in composition as is described below. The pulp is the same as used in the other Examples which is beaten to a Canadian Standard Freeness of 600 at 2.5% consistency, the resin is then added after the pulp is reduced to 1% consistency. The sheets were prepared as in Example 9. The resin level is at 0.2% resin solids on pulp solids. The results of using various acids are as follows:

TABLE III

Effect of Solubilizing Acid On Polymer Creping Properties

| Solubilizing Acid | Creping Properties: Adhesion Rating | Creping Properties: Absorbency of Sheets 0.1 ml $H_2O$ (sec.)[3] |
|---|---|---|
| (a) Acetic Acid | 2.2 | 73 |
| (b) HCl | 2.0 | 50 |
| (c) $H_2SO_4$ | 2.5 | 45 |
| (d) Citric Acid | 2.5 | 45 |
| (e) Propionic Acid | 2.0 | 65 |
| (f) Formic Acid | 2.3 | 80 |
| (g) Nitric Acid | 2.3 | 45 |
| (h) Acetic Acid | 2.5 | 70 |
| (i) Acetic Acid | 2.3 | 57 |

All but sample h were the unquaternized polymer of Example 1a. Sample h was the same polymer 20% quaternized with epichlorohydrin.

EXAMPLE 12

A subjective laboratory method for judging adhesion of the polymer useful in the invention was devised and is described in this Example.

A solution of the solubilized polymer is cast, air-dried, and removed from the casting surface to obtain a film 5 mils (0.127 mm) in thickness. The film is then placed on a steel plate in an oven and heated to a temperature of 140° C. After 10 minutes the steel plate is removed from the oven and adhesion of the film to the plate is measured subjectively. The procedure is to place a wet paper towel, having wet strength, on the film and press it against the film with moderate pressure. An edge of the towel is then grasped and lifted. The subjective adhesion ratings are then recorded.

The following Table gives the results of the adhesion testing:

| | Film of Polymer | Adhesion Rating |
|---|---|---|
| a. | None | 0 |
| b. | Polymer of Example (1b) 20% quat. by ECH | 2.5 |
| c. | Polymer of Example (1a), unquat. | 2.8 |
| d. | Same polymer 10% ECH quat. | 2.7 |
| e. | Same polymer 50% ECH quat. | 2.2 |
| f. | Same polymer 100% ECH quat. | 2.0 |
| g. | Polymer of Example 4 | 2.6 |
| h. | Polymer of Example (1b) but made with 1% initiator | 3.5 |
| i. | Polymer of (1a) 15% quat. with EO | 4.5 |

In the examples, "Versene" is the disodium salt of ethylene diamine tetraacetic acid, and "Formopon" is sodium sulfoxylate formaldehyde—$NaHSO_2.HCHO.2H_2O$.

We claim:

1. A method of creping paper comprising the steps of incorporating in a paper web or paper pulp subsequently formed into a web of paper, an effective amount up to 7% by weight based on pulp solids of a water soluble polymer salt, in aqueous solution, the polymer being derived from an additional polymerizable ethylenically unsaturated amine-containing monomer, and where used, a compound of the formula:

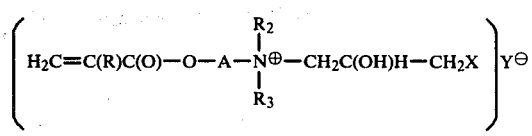

(V)

with or without a compound of the formula:

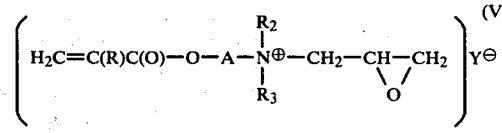

(VI)

wherein $R_2$ and $R_3$ are lower alkyl having 1 to 4 carbon atoms or together with a nitrogen atom form a heterocyclic ring, R is hydrogen or methyl, X is iodine, bromine, or chlorine, A is a ($C_2$–$C_6$ alkylene group having at least two carbon atoms in a chain between the adjoined O an N atoms or A is a polyoxyethylene group of the formula:

$$-(CH_2CH_2O)_xCH_2CH_2-$$

wherein x is from 1 to 11, and

Y is an anion optionally with at least one other monoethylenically unsaturated monomer VIII having a group of the formula:

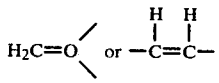

the quantity of the amine-containing monomer being such that the polymer is water-soluble when converted into an organic or inorganic acid salt of the amino component of the polymer, said paper being repulpable by virtue of the water solubility of the salt, in the case of pulp forming a web applying the wet web of said paper to a hot drying surface, and doctoring said web from said surface at a point at which said web contains moisture content of between 2% and 50%, whereby the wet paper web is adhered to the drying surface to an extent which enables the combined adherency and doctoring to achieve improved creping of the paper, and the absorbency being such that 0.1 ml. of water is absorbed by the dry web in less than about 300 seconds.

2. The method of claim 1 in which the amine-containing monomer is dimethylaminoethyl methacrylate, and the ratio of amine monomers to monomers V and VI on an equivalency basis is between 20/0 and 1/1.

3. The method of claim 1 in which the polymer is added to an aqueous paper pulp slurry, and the polymer is derived from monomers including that of the formula:

$$H_2C{=}C(R)C(O)O{-}A{-}N(CH_3)_2$$

in its amine or H salt form wherein

R is hydrogen or methyl, and

A is a ($C_2$–$C_6$) alkylene group having at least two carbon atoms in a chain between the adjoined O and N atoms or A is a polyoxyethylene group of the formula:

$$(CH_2CH_2O)_xCH_2CH_2$$

wherein x is 1 to 11, and

Y is an anion, the polymer optionally containing quaternary groups obtained by reaction of at least one epihalohydrin, and admixture thereof with up to 50% of an alkylene oxide, and optionally with one or more other addition-polymerizable ethylenically unsaturated monomers, the quaternization being only to an extent that the ratio of amine salt groups to quaternary groups on an equivalency basis is between 20/0 and 1/1, subsequently forming the pulp into a sheet, drying it by means of a heated metal drying surface to which it is adhered, and creping the resultant paper by means of doctoring the dry web from said heated metal drying surface, whereby creped paper of low wet strength is obtained.

4. The method of claim 1 in which the monoethylenically unsaturated monomer having a group of the formula:

$$H_2C{=}C< \text{ or } {-}CH{=}CH{-}$$

comprises 0–25% polymerized ethylenically unsaturated acid in the copolymer.

5. Creped paper containing the polymer described in claim 1.

6. A method of creping a wet web of paper comprising the steps of applying an effective amount up to 7% by weight of an addition polymer, based on bone dry paper, to the fibres of a paper or paper pulp subsequently formed into a web of paper, said application being from an aqueous solution of said addition polymer, to give a wet web of paper, said polymer containing polymerized ethylenically unsaturated monomers (a) having amine salt units of the formula:

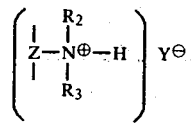

(XI)

as well as optional units of one or more of the formulas:

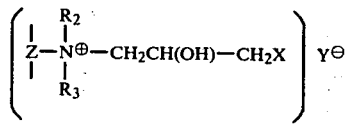

(IX)

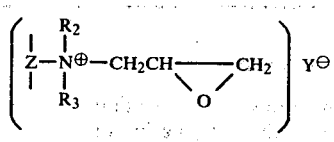

(X)

wherein $R_2$ and $R_3$ are lower alkyl having 1 to 4 carbon atoms, or together with the nitrogen atom form a heterocyclic ring, or optionally in formula XI are H, Y is an anion, X is iodine, bromine, or chlorine, and Z is a part of an addition polymer chain, and, optionally, containing units (b) other than those resulting from monomers yielding groups IX, X, and XI, from at least one monoethylenically unsaturated monomer VIII having a group of the formula:

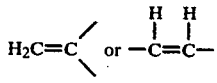

applying the wet web of paper to a hot drying surface, and doctoring said web from said surface at a point at which said web has dried to a moisture content of between 2% and 50%, whereby the paper web is adhered to the drying surface to an extent which enables the combined adherency and doctoring to achieve improved creping of the paper, the quantity of the amine units, before being converted to salt form, being such that the polymer is water soluble when converted into said salt form, said paper thereby being repulpable by virtue of the water solubility of the polymer salt.

7. The method of claim 6 in which the drying surface is the surface of a Yankee dryer.

8. The method of claim 6 in which the amine monomer is tert-butylaminoethyl methacrylate.

9. The method of claim 6 in which the (a) ethylenically unsaturated amine monomer, its amine salt, and the optional quaternary monomers, each calculated as the free amine, and (b) the monomers having one or more of $H_2C{=}C>$ and $-CH{=}CH-$ structures are present in the relative amounts, by weight, of 10–100 (a) with 0–90 (b), the total of (a)+(b) being 100.

10. The method of claim 9 in which (a) the amine, its salt and its optional quaternary is an aminoalkyl ester of at least one of acrylic acid and methacrylic acid, the monomer (b) is at least one of an ester, amide, or nitrile of an $\alpha,\beta$-ethylenically unsaturated carboxylic acid, vinyl aromatic hydrocarbons, vinyl ethers, vinyl lactones, fluorinated vinyl compounds, vinyl halides, vinylidene halides, vinyl alkanol esters of alkanoic acids, unsaturated ketones, and allyl compounds, and in which the relative amounts of (a) and (b) are 10–50 (a) with 50–90 (b), and the absorbency is below about 300 seconds.

11. The method of claim 10 in which at least a major proportion of monomer (b) is at least one of an ester of acrylic acid and methacrylic acid, in which the polymer is free of quaternary groups, the relative amounts being 20–40 (a) with 60–80 (b).

12. The method of claim 11 in which the ester is of a $C_1$–$C_4$ alkanol.

13. The method of claim 10 in which the anion is one or more of a halide, nitrate, phosphate, acid phosphate, sulfate, bisulfite, methyl sulfate, carboxylate, sulfonate, sulfamate, acetate, formate, citrate, oxalate, acrylate, and $\alpha$-methacryloxyacetate.

14. The method of claim 13 in which the anion of the quaternized material is chloride.

15. The method of claim 14 in which the anion of the amine salt is citrate or sulfate.

16. The method of claim 6 in which up to 50% of the units IX and X, when present are replaced by units derived from the amine and ethylene oxide or propylene oxide.

17. The method of claim 10 in which the polymer chain is free of quaternary units.

18. Creped paper containing the polymer described in claim 6.

19. Creped paper containing the polymer described in claim 9.

20. Creped paper containing the polymer described in claim 15.

* * * * *